US010774620B2

(12) United States Patent
Johnson

(10) Patent No.: US 10,774,620 B2
(45) Date of Patent: Sep. 15, 2020

(54) ROV HOT-STAB WITH INTEGRATED SENSOR

(71) Applicant: FMC Technologies, Inc., Houston, TX (US)

(72) Inventor: Mark Alan Johnson, Houston, TX (US)

(73) Assignee: GLOBALFOUNDRIES Inc., Grand Cayman (KY)

( * ) Notice: Subject to any disclaimer, the term of this patent is extended or adjusted under 35 U.S.C. 154(b) by 0 days.

(21) Appl. No.: 16/343,981

(22) PCT Filed: Oct. 24, 2016

(86) PCT No.: PCT/US2016/584050

§ 371 (c)(1),
(2) Date: Apr. 22, 2019

(87) PCT Pub. No.: WO2018/080421

PCT Pub. Date: May 3, 2018

(65) Prior Publication Data

US 2019/0330960 A1 Oct. 31, 2019

(51) Int. Cl.
*E21B 41/04* (2006.01)
*E21B 34/06* (2006.01)
(Continued)

(52) U.S. Cl.
CPC ..... *E21B 41/04* (2013.01); *E21B 34/06* (2013.01); *E21B 33/035* (2013.01); *E21B 34/04* (2013.01);
(Continued)

(58) Field of Classification Search
CPC ..... E21B 41/04
See application file for complete search history.

(56) References Cited

U.S. PATENT DOCUMENTS 4,863,314 A * 9/1989 Baugh ..... F16L 37/62 405/191
5,540,523 A 7/1996 Foret, Jr. et al.
(Continued)

FOREIGN PATENT DOCUMENTS

WO 2006062512 A1 6/2006
WO 2013072688 A2 5/2013

OTHER PUBLICATIONS

American Petroleum Institute, Remotely Operated Tools and Interfaces on Subsea Production Systems, API Recommended Practice 17H, Second Edition, Jun. 2013, Errata, Jan. 2014.
(Continued)

*Primary Examiner* — Tara Mayo-Pinnock
(74) *Attorney, Agent, or Firm* — Amerson Law Firm, PLLC

(57) ABSTRACT

An ROV hot-stab device (100) comprising a hot stab body (102) having a flow bore (102A) that is adapted to receive a fluid, a housing (104) that is operatively coupled to the hot stab body (102), and at least one fluid inlet/outlet (104A/104B) defined in the housing (104). The device (100) also includes an isolation valve (103) that is at least partially positioned within the housing (104) wherein the isolation valve (103) is adapted to, when actuated, establish fluid communication between the bore (102A) of the hot stab body (102) and the at least one fluid inlet/outlet (104A/104B) and at least one sensor (114) positioned at least partially within the housing (104) wherein the sensor (114) is adapted to sense a parameter of the fluid.

24 Claims, 5 Drawing Sheets

(51) Int. Cl.

| | |
|---|---|
| *E21B 33/035* | (2006.01) |
| *E21B 34/04* | (2006.01) |
| *E21B 47/10* | (2012.01) |
| *E21B 34/00* | (2006.01) |

(52) U.S. Cl.
CPC ..... *E21B 47/1025* (2013.01); *E21B 2034/002* (2013.01)

(56) References Cited

U.S. PATENT DOCUMENTS

| | | | | |
|---|---|---|---|---|
| 5,738,172 | A | 4/1998 | van Mook et al. | |
| 5,992,526 | A | 11/1999 | Cunningham et al. | |
| 6,009,950 | A | 1/2000 | Cunningham et al. | |
| 6,188,327 | B1 | 2/2001 | Cousins et al. | |
| 6,200,068 | B1 * | 3/2001 | Bath et al. | F16L 1/26 134/167 C |
| 6,336,508 | B1 | 1/2002 | Guinn | |
| 6,463,801 | B1 | 10/2002 | Young et al. | |
| 6,700,835 | B1 | 3/2004 | Ward et al. | |
| 7,216,715 | B2 * | 5/2007 | Reynolds | E21B 33/035 166/339 |
| 7,677,319 | B2 * | 3/2010 | Baskett | E21B 41/04 166/360 |
| 7,806,187 | B2 * | 10/2010 | Lugo | E21B 41/04 166/338 |
| 7,891,429 | B2 | 2/2011 | Boyce et al. | |
| 8,424,608 | B1 | 4/2013 | Lugo et al. | |
| 8,708,600 | B2 | 4/2014 | Drieu et al. | |
| 9,038,727 | B2 | 5/2015 | Bisset | |
| 9,068,436 | B2 | 6/2015 | Theron et al. | |
| 9,109,419 | B2 | 8/2015 | Fenton | |
| 9,188,246 | B2 | 11/2015 | Sweeney | |
| 9,188,499 | B2 | 11/2015 | Hayward et al. | |
| 9,243,462 | B2 * | 1/2016 | Gutierrez et al. | E21B 19/16 |
| 9,309,739 | B2 | 4/2016 | Wright | |
| 9,322,747 | B2 | 4/2016 | Boe et al. | |
| 2006/0037756 | A1 | 2/2006 | Bath et al. | |
| 2012/0107051 | A1 * | 5/2012 | Sweeney et al. | B08B 9/055 405/184.1 |
| 2012/0117959 | A1 | 5/2012 | Lewkoski | |
| 2012/0267115 | A1 | 10/2012 | Brown et al. | |
| 2012/0275274 | A1 * | 11/2012 | Gochnour et al. | H04B 11/00 367/134 |
| 2013/0025854 | A1 * | 1/2013 | Theron et al. | E21B 27/00 166/264 |
| 2013/0334448 | A1 | 12/2013 | Hodnefiell et al. | |
| 2014/0064029 | A1 | 3/2014 | Jaffrey | |
| 2014/0202768 | A1 * | 7/2014 | Noske | E21B 34/102 175/57 |
| 2014/0305654 | A1 * | 10/2014 | Lugo | E21B 43/013 166/344 |
| 2014/0318797 | A1 | 10/2014 | Vangasse et al. | |
| 2015/0000982 | A1 * | 1/2015 | McDowell et al. | E21B 21/10 175/57 |
| 2015/0075805 | A1 * | 3/2015 | Donald et al. | E21B 33/038 166/368 |
| 2015/0136408 | A1 * | 5/2015 | Wright | F16L 37/086 166/344 |
| 2015/0204167 | A1 | 7/2015 | Skeels et al. | |
| 2015/0285035 | A1 | 10/2015 | Kanstad | |
| 2015/0322743 | A1 | 11/2015 | Thompson et al. | |
| 2015/0361786 | A1 | 12/2015 | Jaffrey | |

OTHER PUBLICATIONS

Kelner, "An ROV-Deployed Deepwater Subsea Sampling System," OTC 23412, 2012.

Shell Brochure, Perdido Stage 2 Subsea Multiphase Sampling (SuMS) FAT/SIT, Apr. 20, 2011.

International Search Report and Written Opinion from PCT/US2016/058405 dated Jun. 6, 2017.

* cited by examiner

ROV HOT-STAB WITH INTEGRATED SENSOR

TECHNICAL FIELD

The present disclosed subject matter generally relates to the field of ROVs (Remotely Operated Vehicles) and the use of such ROVs in subsea applications.

BACKGROUND

With reference to FIG. 1, production of hydrocarbons (oil and/or gas) from subsea oil/gas wells typically involves positioning several items of production equipment 18, 20, e.g., Christmas trees, manifolds, pipelines, flowline skids, pipeline end terminations (PLETs), etc. on the sea floor 16. Flowlines or jumpers 22 are normally coupled to these various items of equipment 18, 20 so as to allow the produced hydrocarbons to flow between and among such production equipment with the ultimate objective being to get the produced hydrocarbon fluids to a desired end-point, e.g., a surface vessel or structure, an on-shore storage facility or pipeline, etc. Jumpers may be used to connect the individual wellheads to a central manifold. In other cases, relatively flexible lines may be employed to connect some of the subsea equipment items to one another. The generic term "flowline" will be used throughout this application to refer to any type of line through which hydrocarbon-containing fluids can be produced from a subsea well.

One challenge facing offshore oil and gas operations involves insuring the flowlines and fluid flow paths within subsea equipment remain open so that production fluid may continue to be produced. The produced hydrocarbon fluids will typically comprise a mixture of crude oil, water, light hydrocarbon gases (such as methane), and other gases such as hydrogen sulfide and carbon dioxide. In some instances, solid materials or debris, such as sand, small rocks, pipe scale or rust, etc., may be mixed with the production fluid as product travels through the flowline. The same challenge applies to other subsea flowlines and fluid flow paths used for activities related to the production of hydrocarbons. These other flowlines and flow paths could be used to, for example, service the subsea production system (service lines), for injecting water, gas or other mixture of fluids into subsea wells (injection lines) or for transporting other fluids, or hydraulic control lines operating equipment that come in direct contact with production fluids and causing a potential contamination of control fluids (control lines) should seal barriers degrade.

Problems encountered in the production of hydrocarbon fluids from subsea wells are often multi-faceted where blockage may form in a subsea flowline or in a piece of subsea equipment from a variety of causes from hydrate formation to coagulation or precipitation of byproducts from different fluids coming in contact with one another. In some cases the blockage can completely block passageways (flowlines or control/service lines) while in other cases there is only partially blockage to the flowline/equipment which thereby degrades performance or throughput. However, as used herein, the term "blockage" should be understood to complete or partial blockage of a passageway. For example, solid materials entrained in the produced fluids may be deposited during temporary production shut-downs, and the entrained debris may settle so as to form all or part of a blockage in a flowline or item of production equipment. As another example chemical reactions between two (normally separate) fluids may result in an unwanted precipitate or byproduct that could create a blockage.

In general, hydrates may form under appropriate high pressure and low temperature conditions. As a general rule of thumb, hydrates may form at a pressure greater than about 0.47 MPa (about 1000 psi) and a temperature of less than about 21° C. (about 70° F.), although these numbers may vary depending upon the particular application and the composition of the production fluid. Subsea oil and gas wells that are located at water depths greater than a few hundred feet or located in cold weather environments, are typically exposed to water that is at a temperature of less than about 21° C. (about 70° F.) and, in some situations, the surrounding water may only be a few degrees above freezing. Although the produced hydrocarbon fluid is relatively hot as it initially leaves the wellhead, as it flows through the subsea production equipment and flowlines, the surrounding water will cool the produced fluid. More specifically, the produced hydrocarbon fluids will cool rapidly when the flow is interrupted for any length of time, such as by a temporary production shut-down. If the production fluid is allowed to cool to below the hydrate formation temperature for the production fluid and the pressure is above the hydrate formation pressure for the production fluid, hydrates may form in the produced fluid which, in turn, may ultimately form a blockage which may block the production fluid flow paths through the production flowlines and/or production equipment. Of course, the precise conditions for the formation of hydrates, e.g., the right combination of low temperature and high pressure is a function of, among other things, the gas-to-water composition in the production fluid which may vary from well to well. When such a blockage forms in a flowline or in a piece of production equipment, either a hydrate blockage or a debris blockage or a combination of both, it must be removed so that normal production activities may be resumed.

When a hydrate blockage does form in the flowline 22 or the production equipment 18, 20, the only recourse is to do one or more of (1) reducing the pressure on one (or both) sides of the hydrate blockage restriction; (2) warm the surrounding equipment; and/or (3) introduce chemicals to change phase properties to melt the hydrate blockage so as to re-open the flowline or equipment. These hydrate remediation tasks are often time consuming and, depending on where the hydrate blockage forms, it may be more problematic to remove. The remediation process also requires a high degree of pressure integrity, i.e., insuring the absence of spurious or extraneous small leak path sources associated with intervention hardware and conduits. Otherwise diagnosing and monitoring desired changes and rates in pressure, temperature, chemical treatment rates, and avoidance of water or other contaminating sources ingress may hamper or thwart attempts to remove the blockage. With reference to FIG. 1, hydrate remediation activities often involve use of a surface vessel 12 that is located on the surface 14 of the water, an ROV (Remotely Operated Vehicle) 30 that is operatively coupled to the vessel 12 via a schematically depicted line 24 to enable an operator on the vessel 12 to control the ROV 30. In this example, a hydrate remediation skid 32 is coupled to the ROV 30. In some cases, the hydrate remediation skid 32 may include various sensors (e.g., pressure, temperature, etc.), pumps, valves, and the like so as to allow the performance of one or more the hydrate remediation activities described above. In some case, the hydrate remediation skid 32 may also contain its own supply of chemicals, e.g., methanol, to be injected into the flowline/equipment. The ROV 30 also includes a simplistically depicted robotic arm 31 and a schematically depicted ROV hot-stab 40 that is coupled to the ROV 30 via a tether or umbilical 44. In some applications, the hot-stab 40 may also include a schematically depicted manually actuated isolation valve 43 that may be mechanically actuated by use of the robotic arm 31. See, for example, U.S. Pat. No. 6,009,950 and US Patent Publication 20130334448. In general, during various hydrate remediation activities, the end 42 of the hot-stab 40 may be inserted into any of a plurality of simplistically depicted access points 23 in the flowlines 22 and/or the equipment 18, 20 so that certain activities may be performed. For example, chemicals may be injected into the flowlines 22 and/or the equipment 18, 20 via the hot-stab 40 using the equipment on the hydrate remediation skid 32. As another example, production fluid and or sublimated components of the hydrate blockage may be withdrawn from the flowlines 22 and/or the equipment 18, 20 via the hot-stab 40 using the equipment on the hydrate remediation skid 32.

In any event, when production is lost due to the formation of a hydrate blockage, the operator's revenue stream is curtailed and the only option may be to bleed off pressure downstream of the hydrate blockage to a pressure that is less than the hydrate formation pressure. In some cases, this means a large portion of the equipment infrastructure must be shut in and hydrocarbons vented so that the hydrate blockage can slowly sublimate from the depressurize side of the blockage. Eventually the blockage melts a sufficient amount such that it frees itself from the sides of the bore in the flowline/equipment. At that point the trapped higher pressure behind the remaining portion of the blockage may send all or part of the blockage hurtling down the bore in the flowline/equipment until it can be stopped and allowed to melt the rest of the way. Some hydrate blockages may be of sufficient mass that, when they are initially "freed" they can travel at speeds that could pose an issue as it relates to the damage of downstream flowline/equipment hit by the released blockage.

In some cases, the hydrate remediation process may involve bleeding off pressure on the upstream side of the blockage until such time as there is a vacuum (or lower pressure below the hydrate formation pressure) in the bore of the flowline/equipment on the upstream side of the blockage. As the hydrate blockage melts, it sublimates back to its water and natural gas constituents thereby slowly rebuilding the pressure on the upstream side of the blockage. The remediation equipment, e.g., the equipment on the hydrate remediation skid 32, is then used to remove, via the hot-stab 40, the sublimated constituents of the blockage to maintain the lower pressure environment on the upstream side of the blockage such that the melting process continues. However, this continual draw down process has its share of technical problems as fluids/gases are withdrawn and pressure is kept below the hydrate formation pressure.

In general, the hydrate remediation equipment in the hydrate remediation skid 32 is somewhat removed distance wise from the access point 23 in the flowlines 22 and/or the equipment 18, 20 that contains the hydrate blockage. For example, in some applications, the umbilical between 44 between the hot-stab 40 may be about 2-3 meters in length. In practice the umbilical 44 may comprise a plurality of lengths of flexible hose that are coupled together using various connections so as to establish a fluid tight conduit through which liquids may flow. Thus, as the length of the umbilical 44 increases, there are more potential leakages sites in the various hose connections that are used to make-up between the hot stab 40 and the remediation skid 32, which increases the likelihood of putting more mechanical strain on these connections as operations take place, possibly loosening these connections. Examples of potential leakage sources include, but are not limited to, leakage around the remediation skid's 32 internal hardware/plumbing, leakage around the internal seals within its pumping equipment and leakage at the site of the connection to the ROV hot stab access point 40 itself, etc. Specifically identifying when leakages occur and where the leakage sites are located in the overall remediation skid hardware 32 and/or the umbilical 44 in real-time and determining the leakage rate (as well as increases or decreases in the leakage rate) can also be problematic. The location of the pumps, hardware piping and sump hardware in the remediation skid 32 that may be positioned relatively far away from the access point can reduce draw down efficiency and lengthen the duration of the remediation process activities. For example, in the case where production fluid is removed from the flowlines 22 and/or the equipment 18, 20 via the hot-stab 40 so as to create a relatively low pressure on one side of the blockage, leakage in the umbilical 44 can result in water from the surrounding environment entering the umbilical 44 if the hydrostatic pressure is greater than the reduced pressure in the umbilical 44. In addition, since the gauges or sensors that are used to monitor and record conditions during the hydrate remediation activities are located in the remediation skid 32, the readings obtained by these gauges or sensors may not accurately reflect the actual process conditions at or near the hydrate blockage or within the flowlines 22 and/or the equipment 18, 20 because of a variety of factors, such as expansion of the umbilical 44, fluid flow friction losses and the further cooling of the fluid in the umbilical 44 (due to the cold sea water environment) as it travels from the access point 23 to the remediation skid 32, making it difficult to monitor hydrate sublimation.

The present application is directed to a unique ROV hot-stab with at least one integrated sensor and methods of using such an ROV hot-stab that may eliminate or at least minimize some of the problems noted above.

SUMMARY

The following presents a simplified summary of the subject matter disclosed herein in order to provide a basic understanding of some aspects of the information set forth herein. This summary is not an exhaustive overview of the disclosed subject matter. It is not intended to identify key or critical elements of the disclosed subject matter or to delineate the scope of various embodiments disclosed herein. Its sole purpose is to present some concepts in a simplified form as a prelude to the more detailed description that is discussed later.

The present application is generally directed to a unique ROV hot-stab with at least one integrated sensor. In one example, the ROV hot-stab comprises, among other things, a hot stab body having a flow bore that is adapted to receive a fluid, a housing that is operatively coupled to the hot stab body, and at least one fluid inlet/outlet defined in the housing. In this illustrative example, the device also includes an isolation valve that is at least partially positioned within the housing wherein the isolation valve is adapted to, when actuated, establish fluid communication between the bore of the hot stab body and the at least one fluid inlet/outlet and at least one sensor positioned at least partially within the housing wherein the sensor is adapted to sense a parameter of the fluid.

BRIEF DESCRIPTION OF THE DRAWINGS

Certain aspects of the presently disclosed subject matter will be described with reference to the accompanying drawings, which are representative and schematic in nature and are not be considered to be limiting in any respect as it relates to the scope of the subject matter disclosed herein.

Figure 1:
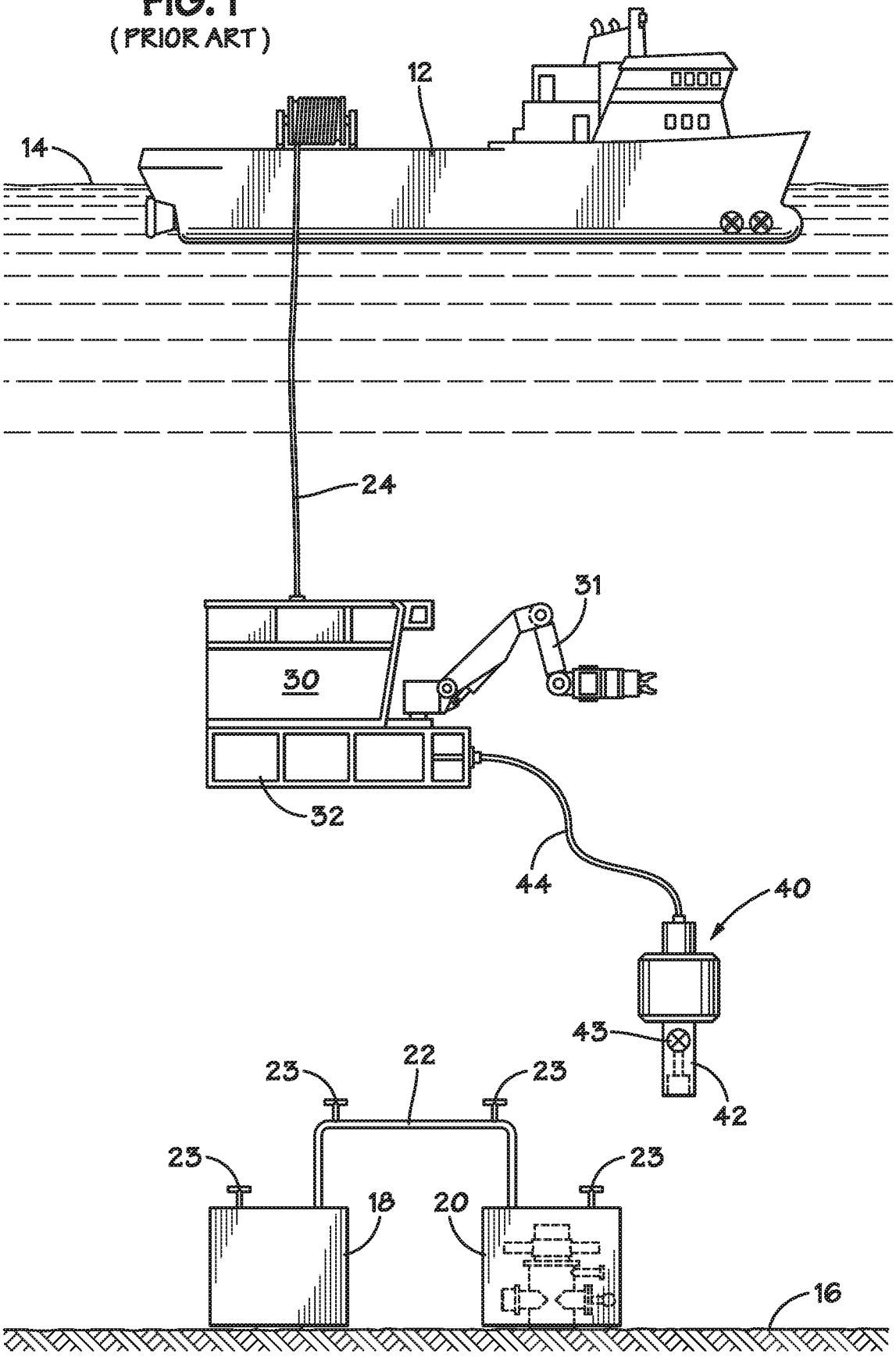
FIG. 1 (PRIOR ART)
FIG. 1 depicts an illustrative prior art ROV-mounted hydrate remediation skid and a prior art ROV hot-stab used in performing hydrate remediation activities.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DESCRIPTION OF EMBODIMENTS

Various illustrative embodiments of the disclosed subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 2A:
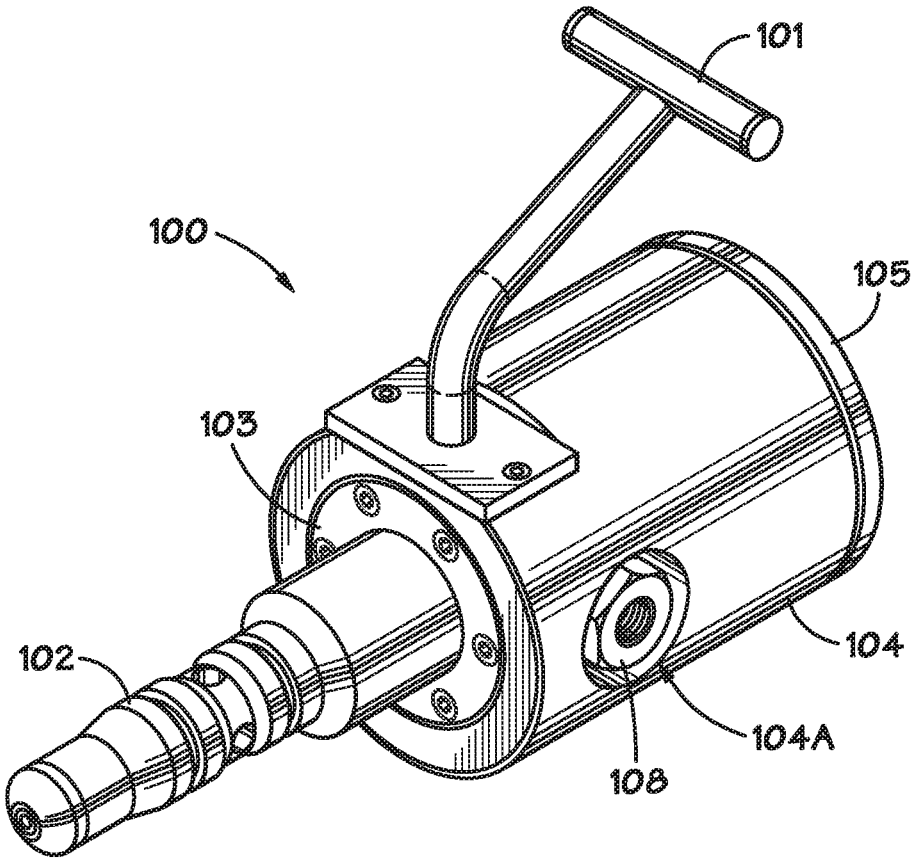
FIG. 2A is a perspective view of one illustrative embodiment of a unique ROV hot-stab with at least on integrated sensor disclosed herein.
Figure 2B:
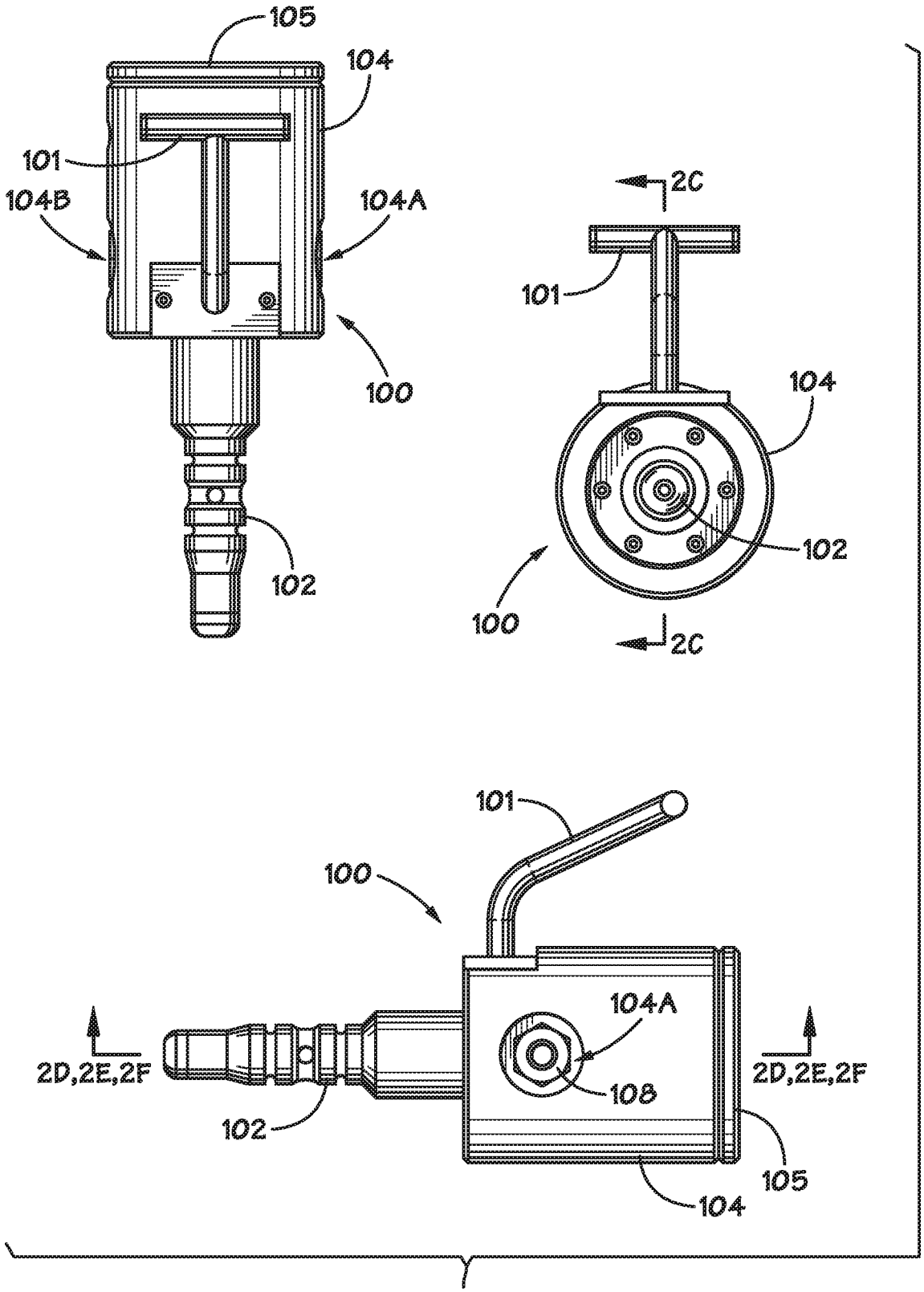
FIG. 2B contains top, side and end views of one illustrative embodiment of a unique ROV hot-stab with at least on integrated sensor disclosed herein.

One illustrative example of a novel ROV hot-stab 100 with at least on integrated sensor disclosed herein will now be described with reference to the attached drawings. In one illustrative embodiment, the ROV hot-stab 100 comprises a hot stab body 102 having a fluid flow bore 102A, a valve body 103 and actuator housing 104 that is operatively coupled to the hot stab body 102 and an ROV handle 101. An endcap 105 is removably coupled to the main housing 104 by a plurality of threaded fasteners. As shown in, for example, FIGS. 2A, and 2E, the ROV hot-stab 100 further comprises at least one illustrative fluid inlet/outlet 104A/104B defined in the housing 104. In general, the hot stab body or probe 102 may be inserted into an access point in a flowline or item of equipment such that fluids may be injected into or removed from the flowline or equipment as necessary. In one illustrative example, the ROV hot-stab 100 may be particularly useful when performing hydrate remediation activities on subsea flowlines and/or items of equipment that are positions subsea, such as, for example, Christmas trees, manifolds, pipelines, flowline skids, pipeline end terminations (PLETs), etc. The hot stab body 102 may be of any destined size or configuration. In one illustrative example, the hot stab body 102 may have a size and configuration that is suggested or mandated by various standards, e.g., API RP 17H or ISO 13628-8. In other applications, the hot stab body 102 may have a non-standardized size and/or configuration. Similarly, the ROV handle 101 may be of any desired shape or configuration. In one illustrative embodiment, the ROV handle 101 may have a size and configuration that is suggested or mandated by a standard, e.g., API RP 17H, to facilitate handling by an ROV manipulator arm. The materials of construction for the ROV hot-stab 100 may vary depending upon the particular application where it is used.

Figure 2C:
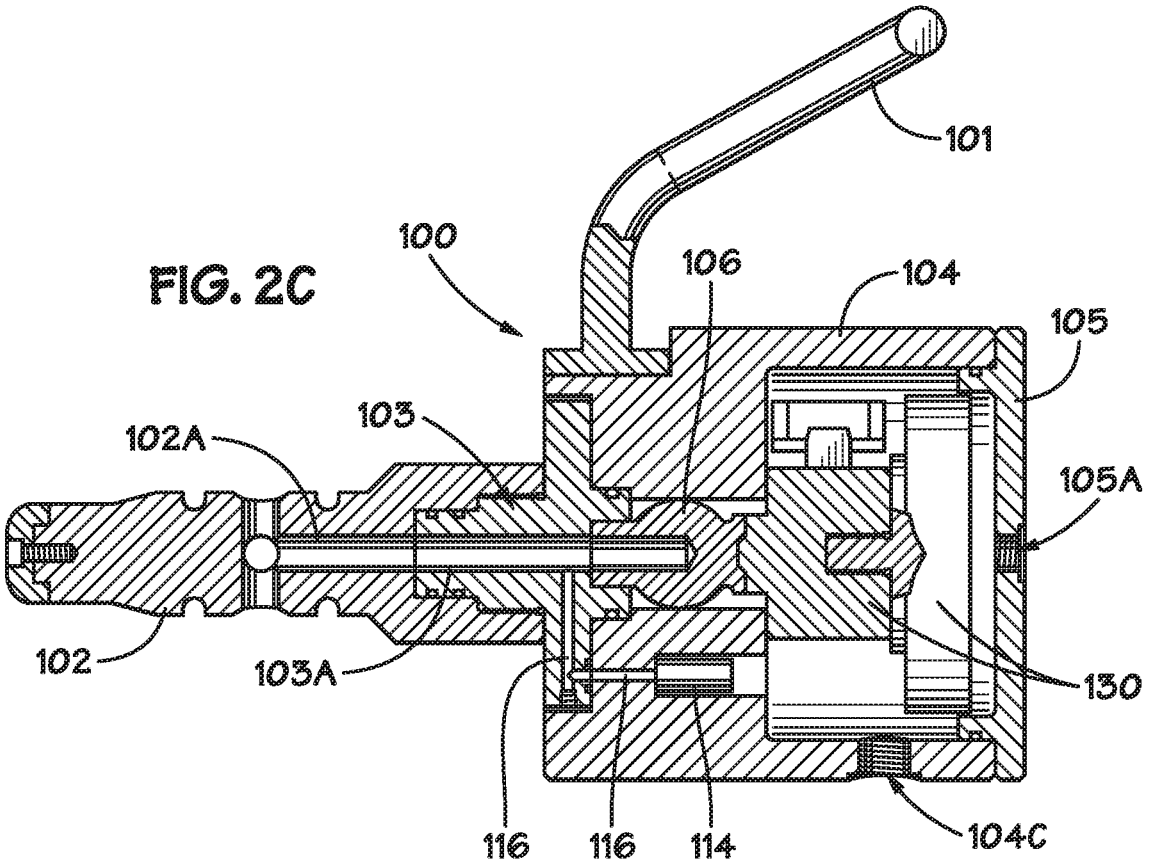
FIG. 2C is a cross-sectional view of one illustrative embodiment of a unique ROV hot-stab with at least on integrated sensor disclosed herein taken where indicated in FIG. 2B.
Figure 2D:
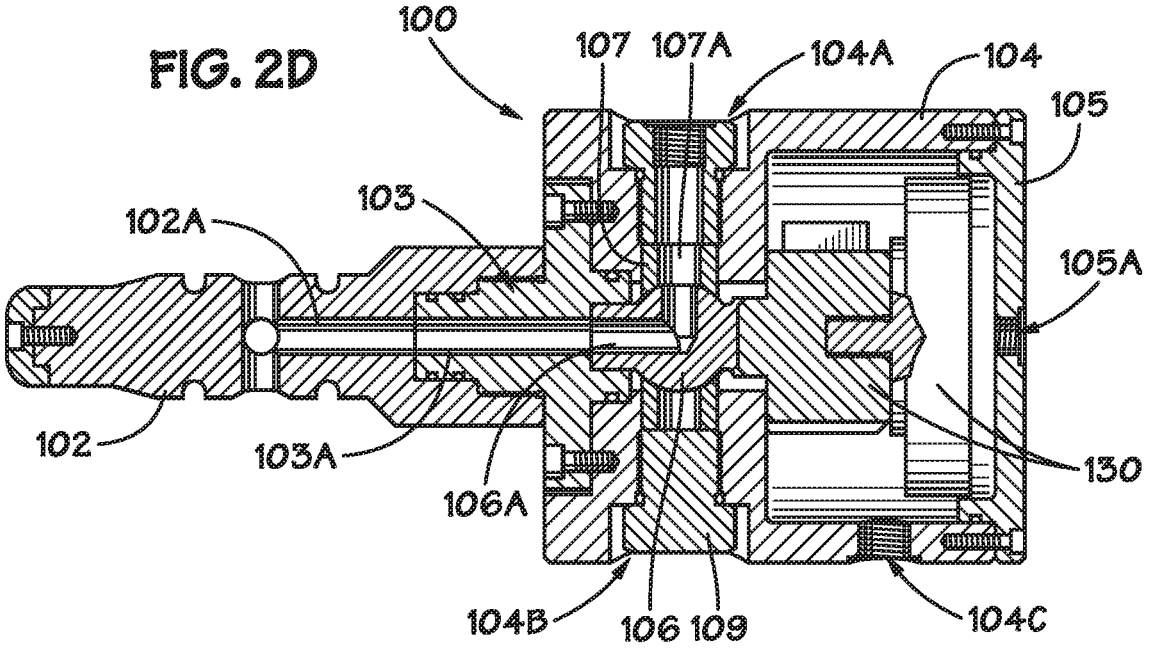
FIG. 2D is another cross-sectional view of one illustrative embodiment of a unique ROV hot-stab with at least on integrated sensor disclosed herein taken where indicated in FIG. 2B.
Figure 2E:
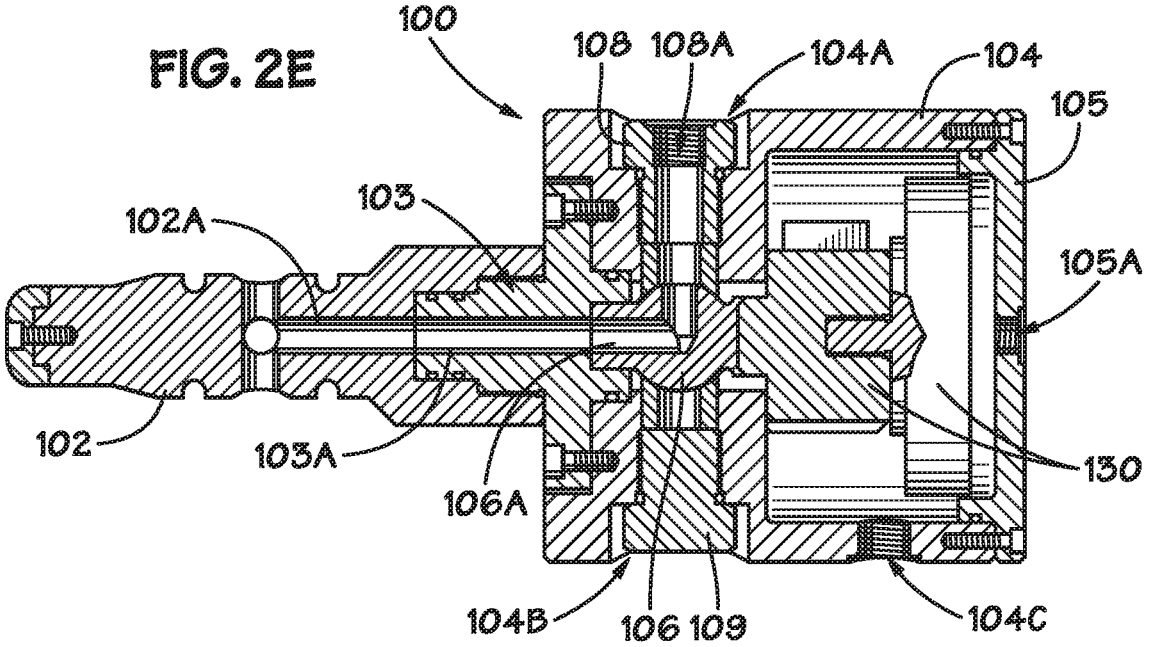
FIG. 2E is another cross-sectional view of one illustrative embodiment of a unique ROV hot-stab with at least on integrated sensor disclosed herein taken where indicated in FIG. 2B.

With reference to FIGS. 2A-2F, one illustrative embodiment of the ROV hot-stab 100 may further comprise an isolation valve 103 and at least one sensor 114 (e.g., a pressure sensor and/or a temperature sensor such as a thermocouple, etc.) positioned within the housing 104. In one illustrative embodiment, the isolation valve 103 comprises a valve element 106 (with a fluid flow path 106A defined therein) and a valve seat 107 (with a fluid flow path 107A defined therein). As shown in FIG. 2C, multiple sensors 114 may be positioned in the housing 104 depending upon the particular application. The sensor(s) 114 may be positioned within any open area inside of the housing 104 and the housing 104 may be filled with a fluid such oil, grease or a pressure compensating fluid. As shown in FIG. 2C, a plurality of cross-drilled lines 116 (porting lines) are formed in the housing 104 to allow the sensor(s) 114 to monitor a parameter (e.g., pressure, temperature, etc.) of the fluid in the concentric inlet bore 103A of the valve 103 at a location that is just upstream of the isolation valve element 106 so that the sensor(s) 114 can sense the desired parameter(s) of the conditions inside the access point that the hot stab body 102 is inserted into irrespective of whether the isolation valve 103 is open or closed. In the depicted example, the illustrative sensor 114 is positioned in one of the lines 116. Terminal leads (not shown) of the sensor(s) 114 may take the form of a bulkhead connection that allows power and data telemetry to pass to and from the sensor 114 to, for example, a communication system (not shown) resident on an ROV. Of course, as will be appreciated by those skilled in the art after a complete reading of the present application, the sensor 114 may be other types of sensors other than the illustrative pressure sensor and temperature sensor discussed above, e.g., a flow rate sensor, a magnetometer and densitometer, etc.

Figure 2F:
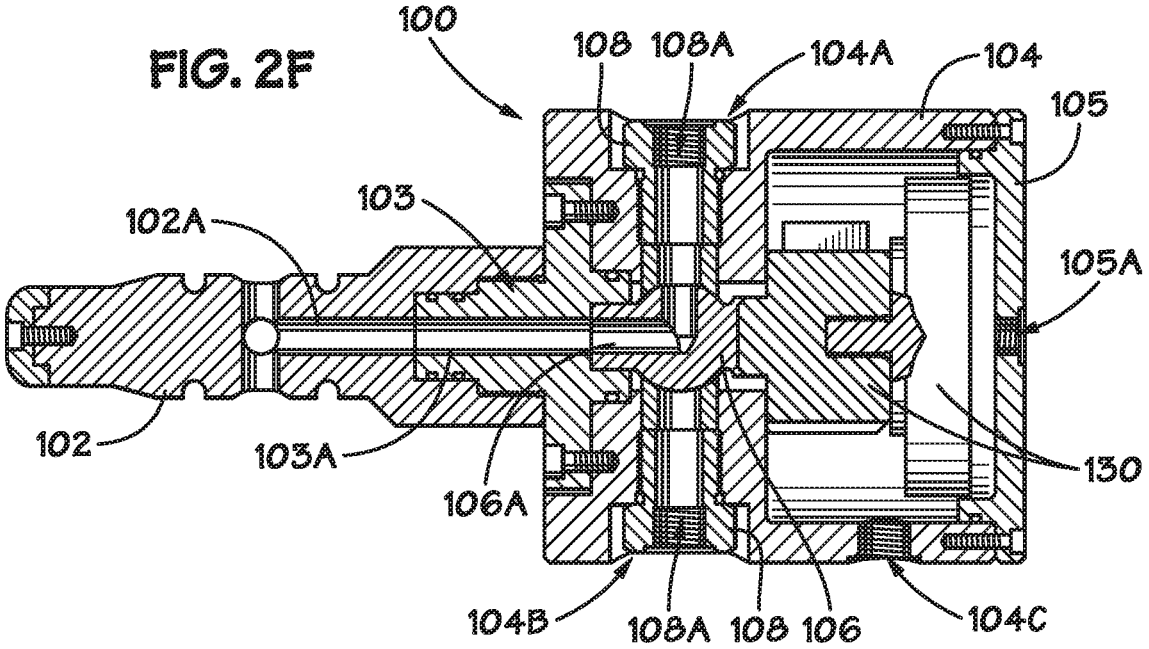
FIG. 2F is another cross-sectional view of one illustrative embodiment of a unique ROV hot-stab with at least on integrated sensor disclosed herein taken where indicated in FIG. 2B.

In one illustrative embodiment, the isolation valve element 106 may take the form of a two-position, three-way ball valve that is positioned in the valve seat 107. The concentric inlet bore 103A of the valve 103 protrudes into the hot stab body 102 so as to enable fluid communication with flow bore 102A of the hot stab body 102. In the depicted example, the first and second fluid inlet/outlets 104A/104B take the form of threaded openings that are defined in the housing 104. A threaded plug 108 with an opening 108A defined therein is threadingly coupled to the opening 104A. Additionally, a threaded sealed plug body 109 is threadingly coupled to the opening 104B so as to block fluid flow through the second fluid inlet/outlet 104B. Of course, if desired, a threaded plug 108 (with the opening 108A formed therein) may also be positioned within the second fluid inlet/outlet 104B depending upon the particular application, as depicted in FIG. 2F. As will be appreciated by those skilled in the art after a complete reading of the present application, the ball valve element 106 is but one example of the type of valve element 106 that may be employed with the ROV hot-stab 100 disclosed herein. For example, the valve element 106 may also be one of a needle valve element, a gate valve element, or a plug valve element 106 that is configured to mate with as associated valve seat 107.

In general, the isolation valve 103 may be at least partially positioned within the housing 104 and the isolation valve 103 is adapted to, when actuated, establish fluid communication between the bore 102A of the hot stab body 102 and at least one fluid inlet/outlet, e.g. the first fluid inlet/outlet 104A and/or the second fluid inlet/outlet 104B, depending upon how the ROV hot-stab 100 is configured. The isolation valve 103 may be actuated by any means e.g., mechanical, electrical, hydraulic, etc., and such an actuator that may be positioned (in whole or part) internal or external to the housing 104. In the depicted example, the ROV hot-stab 100 comprises an electrical actuator 130 that is positioned within the housing 104. More specifically, in the illustrative embodiment disclosed herein, the actuator 130 may take the form of a flat plate electric stepping motor that is adapted to actuate the isolation valve element 106 from a fully closed position to a fully open position with the further capability of incrementally moving the element 106 from the fully closed position to the fully open positioned (or vice-versa). For example, in the case where the actuator is a stepping motor, the actuator 130 may be used to move the illustrative valve element 106 in angular increments from its fully closed position to its fully open position such that the valve 103 may be used as a throttling device. Of course, the isolation valve 103 may take other forms, e.g., a two-position three-way valve to divert the fluid outlet to a third port (not shown) in the housing 104 that could lead to another component such as, for example, a fluid sampling chamber, etc.

Power and control utilities may be provided to the actuator 130 via an opening 105A defined the back cover plate 105 of the housing 104. Terminal leads (not shown) may pass through the opening 105A in the form of a bulkhead connection that allow power and data telemetry to pass to the actuator 130. In another embodiment, where the actuator is in the form of a hydraulically powered actuator, the openings 105A/104C may function as hydraulic inlet and outlets for internal fluid power and control of the actuator 130. The various lines for the utilities for powering and communicating with the actuator 130 the sensor(s) 114 may be part of an umbilical (not shown) that is operatively coupled to the ROV hot-stab 100 and an ROV (not shown). Such an umbilical would also include at least one fluid flow line to allow fluids to be inserted into or removed from the flowline or equipment into which the hot stab body 102 of the ROV hot-stab 100 is inserted. The size of these various lines or cables may vary depending upon the size and type of actuator 130, the number and type of sensor(s) 114 and the manner nature of the fluids to be injected into and/or removed from the flowline or equipment. As will be appreciated by those skilled in the art after a complete reading of the present application, in some embodiments, depending upon the capabilities of the ROV, the illustrative ROV-mounted remediation skid 32 described in the background section of this application may be omitted. For example, if the ROV has on-board pumping and valve capabilities, the ROV hot-stab 100 may be controlled and operated using only the ROV's control system when performing at least some activities.

The unique ROV hot-stab 100 may be configured and operated in several ways depending upon the particular application. For example, with the embodiment depicted in FIG. 2C, with the second fluid inlet/outlet 104B plugged (with the plug 109) or closed, all fluid flow into or out of the flowline or equipment will flow through the first inlet/outlet 104A. As noted before, the valve 103 may be actuated from its fully closed position to it fully open positioned (or any position in between those two extremes) to allow such fluid flow. That is, the illustrative ball valve element 106 of the isolation valve 103 depicted herein may be rotated ninety degrees to fully open or fully close the valve 103. In another embodiment, the sealed plug body 109 may be removed from the second fluid inlet/outlet 104B replaced with a ported sealed plug (like the plug 108 with the opening 108A formed therein) thereby providing a second fluid injection/extraction point. For example, such a secondary injection point may be desirable to inject a chemical into the flowline or equipment or used as an extraction point for removing certain types of fluids from within the flowline or equipment. In this particular configuration, the actuator 130 could be used to rotate the illustrative isolation valve element 106 ninety degrees from its closed position (not shown) to the position shown in FIG. 2F to thereby allow fluid communication between the first fluid inlet/outlet 104A and the flowline or equipment via the hot stab body 102 while blocking the second inlet/outlet 104B. At some point later in time, the valve element 106 could be rotated 180 degrees such that fluid communication is established between the second inlet/outlet 104B and the flowline or equipment via the hot stab body 102 while the first fluid inlet/outlet 104A is blocked (however this valve position is not depicted in the drawings). Of course, the ROV hot-stab 100 may be provided with any desired number of fluid inlet/outlet points as desired for the particular application with while perhaps making additional changes in the number and/or configuration of the arrangement of valves in the ROV hot-stab 100.

As will be appreciated by those skilled in the art after a complete reading of the present application, positioning the at least one sensor 114 in the ROV hot-stab 100 may provide several advantages as compared to prior art ROV hot-stabs.

For example, in the case where the ROV hot-stab 100 is used in hydrate remediation processes, the sensor(s) 114 is positioned such that it has access to the bore 103A (via the lines 116) at a location upstream of the isolation valve element 106. Accordingly, the sensor(s) 114 may be used to monitor the hydrate's sublimation process unabated, i.e., with the valve 103 in the closed or open position. Since the sensor(s) 114 is physically closer to the hydrate blockage than prior art sensors on the hydrate remediation skid 32 discussed in the background section of this application, the readings obtained by the sensor(s) 114, e.g., temperature and/or pressure, are more likely to reflect the true temperature and pressure of the sublimation process. For example, by positioning the sensor(s) 114 in the ROV hot-stab 100, changes in the temperature of the process fluid is sensed before it loses temperature to it surrounding environment, e.g., the surround water, which was the case with prior art temperature sensors positioned on a prior art ROV mounted remediation skid. Similarly, by positioning a pressure sensor in the ROV hot-stab 100, the pressure of the fluid or equipment is sensed without have to account for any pressure drop associated with flowing the fluid to a relatively remotely placed ROV-mounted remediation skid that contains a pressure sensor. By positioning the sensor(s) 114 in the ROV hot-stab 100 worries about errors in the measured parameters of the fluid due to leaks in the fluid flow lines that extend from the ROV hot-stab 100 to the ROV can be eliminated. Additionally, by use of the unique ROV hot-stab 100 disclosed herein with an integrated sensor(s) positioned within the hot stab itself, one or more of the problems noted in the background section of this application may be eliminated or at least minimized by enabling by isolating the remediation skid equipment 32/44 from the flowline environment 18/22 at the access point 23 interface. By using the ROV hot-stab 100 disclosed herein with the integrated valve 103 and sensor 114, the efficacy of the remediation processes (that may involve pressure drawdown and hydrate sublimation) may be more closely monitored and better controlled as compared to prior art techniques since the novel ROV hot-stab 100 enables one to obtain more accurate information as to the actual process conditions in the flowline adjacent any blockage since the sensor(s) are positioned more closely to the actual environment within the flowline or equipment that needs to be monitored. Additionally, using the ROV hot-stab disclosed herein with the integrated sensor 114 potential leak paths from other sources may be identified, minimized and/or eliminated by locating the necessary sensors and isolation valve as close to the access point as physically possible. Moreover, the isolation valve 103 is adapted to, when actuated, isolates an access point 23 into which the hot stab body 102 is inserted from additional equipment in fluid communication with the hot stab body 102, e.g., the rest of the intervention equipment (such as the remediation skid 32 and the umbilical 44) to thereby minimize extraneous leak paths, and thus improve the monitoring accuracy of the sensor 114.

The particular embodiments disclosed above are illustrative only, as the disclosed subject matter may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the claimed subject matter. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

The invention claimed is:

1. A remotely operated vehicle (ROV) hot-stab device that is adapted to inject fluids into and extract fluids from a subsea line or a subsea equipment item, the ROV hot-stab device comprising:

a hot stab body comprising a flow bore that is adapted to receive a fluid, wherein the hot stab body is adapted to be inserted into a hot stab access point on said subsea line or said subsea equipment item so as to establish fluid communication between said subsea line or said subsea equipment item and the flow bore;

a housing that is operatively coupled to the hot stab body;

at least one fluid inlet/outlet defined in the housing;

an isolation valve that is at least partially positioned within the housing at a location between the flow bore and the at least one fluid inlet/outlet wherein the isolation valve is adapted to, when actuated, establish fluid communication between the flow bore of the hot stab body and the at least one fluid inlet/outlet; and at least one sensor positioned at least partially within the housing wherein the sensor is adapted to sense a parameter of the fluid.

2. The device of claim 1, wherein the at least one sensor comprises at least one of a pressure sensor, a temperature sensor, a flow rate sensor, a magnetometer, or a densitometer.

3. The device of claim 1, wherein the isolation valve comprises one of a ball valve element, a needle valve element, a gate valve element, or a plug valve element and a mating valve seat.

4. The device of claim 1, further comprising a valve actuator that is positioned at least partially within the housing wherein the valve actuator is adapted to actuate the isolation valve.

5. The device of claim 4, wherein the valve actuator comprises one of a mechanical, electrical or hydraulic actuator.

6. The device of claim 4, wherein the valve actuator is positioned entirely within the housing.

7. The device of claim 6, wherein the valve actuator comprises an electric stepper motor.

8. The device of claim 1, wherein the at least one sensor is adapted to sense the parameter of the fluid at a position upstream of the isolation valve irrespective of whether the isolation valve is closed or open.

9. The device of claim 1, wherein the at least one sensor comprises a plurality of sensors.

10. The device of claim 1, wherein the at least one sensor comprises at least one of a pressure sensor, a temperature sensor, a flow rate sensor, a magnetometer and a densitometer that is positioned entirely within the housing.

11. The device of claim 1, wherein the isolation valve is adapted to, when actuated, isolate the hot stab access point into which the hot stab body is inserted from additional subsea flow lines or subsea equipment items that are in fluid communication with the hot stab body.

12. The device of claim 1, further comprising a handle coupled to the hot stab body wherein the handle is in accordance with API RP 17H.

13. The device of claim 1, wherein a size of the hot stab body is in accordance with ISO 13628-8.

14. A remotely operated vehicle (ROV) hot-stab device that is adapted to inject fluids into and extract fluids from a subsea line or a subsea equipment item, the ROV hot-stab device comprising:

a hot stab body comprising a flow bore that is adapted to receive a fluid, wherein the hot stab body is adapted to be inserted into a hot stab access point on said subsea line or said subsea equipment item so as to establish fluid communication between said subsea line or said subsea equipment item and the flow bore;

a housing that is operatively coupled to the hot stab body;

at least one fluid inlet/outlet defined in the housing;

an isolation valve that is at least partially positioned within the housing at a location between the flow bore and the at least one fluid inlet/outlet wherein the isolation valve is adapted to, when actuated, establish fluid communication between the flow bore of the hot stab body and the at least one fluid inlet/outlet;

at least one sensor positioned entirely within the housing wherein the sensor is adapted to sense a parameter of the fluid at a position upstream of the isolation valve irrespective of whether the isolation valve is closed or open; and a valve actuator that is positioned at least partially within the housing wherein the valve actuator is adapted to actuate the isolation valve.

15. The device of claim 14, wherein the at least one sensor comprises at least one of a pressure sensor, a temperature sensor, a flow rate sensor, a magnetometer, or a densitometer.

16. The device of claim 14, wherein the isolation valve comprises one of a ball valve element, a needle valve element, a gate valve element, or a plug valve element and a mating valve seat.

17. The device of claim 14, wherein the valve actuator comprises one of a mechanical, electrical or hydraulic actuator.

18. The device of claim 14, wherein the valve actuator is positioned entirely within the housing.

19. The device of claim 18, wherein the valve actuator comprises an electric stepper motor.

20. The device of claim 14, wherein the at least one sensor comprises a plurality of sensors.

21. The device of claim 14, wherein the at least one fluid inlet/outlet comprises a plurality of fluid inlet/outlets.

22. The device of claim 14, wherein the isolation valve is adapted to, when actuated, isolate the hot stab access point into which the hot stab body is inserted from additional subsea flow lines or subsea equipment items that are in fluid communication with the hot stab body.

23. A remotely operated vehicle (ROV) hot-stab device, comprising:

a hot stab body comprising a flow bore that is adapted to receive a fluid;

a housing that is operatively coupled to the hot stab body;

at least one fluid inlet/outlet defined in the housing;

an isolation valve that is at least partially positioned within the housing, wherein the isolation valve is adapted to, when actuated, establish fluid communication between the bore of the hot stab body and the at least one fluid inlet/outlet;

at least one sensor positioned at least partially within the housing, wherein the sensor is adapted to sense a parameter of the fluid; and a valve actuator that is positioned at least partially within the housing, wherein the valve actuator is adapted to actuate the isolation valve, wherein the valve actuator is positioned entirely within the housing.

24. A remotely operated vehicle (ROV) hot-stab device that is adapted to inject fluids into and extract fluids from a subsea line or a subsea equipment item, the ROV hot-stab device comprising:

a hot stab body comprising a flow bore that is adapted to receive a fluid, wherein the hot stab body is adapted to be inserted into a hot stab access point on the subsea line or the subsea equipment item so as to establish fluid communication between the subsea line or the subsea equipment item and the flow bore;

a housing that is operatively coupled to the hot stab body;

at least one fluid inlet/outlet defined in the housing;

an isolation valve that is at least partially positioned within the housing, wherein the isolation valve is adapted to, when actuated, establish fluid communication between the bore of the hot stab body and the at least one fluid inlet/outlet;

at least one sensor positioned entirely within the housing, wherein the sensor is adapted to sense a parameter of the fluid at a position upstream of the isolation valve irrespective of whether the isolation valve is closed or open; and a valve actuator that is positioned at least partially within the housing, wherein the valve actuator is adapted to actuate the isolation valve, wherein the valve actuator is positioned entirely within the housing.

* * * * *